US007937814B2

(12) United States Patent
Voit

(10) Patent No.: US 7,937,814 B2
(45) Date of Patent: May 10, 2011

(54) APPARATUS AND MEANS FOR THE INTERNMENT OF THE DECEASED

(76) Inventor: Troy D. Voit, Oxford, WI (US)

( * ) Notice: Subject to any disclaimer, the term of this patent is extended or adjusted under 35 U.S.C. 154(b) by 239 days.

(21) Appl. No.: 12/357,379

(22) Filed: Jan. 21, 2009

(65) Prior Publication Data

US 2010/0180521 A1 Jul. 22, 2010

(51) Int. Cl.
*A61G 17/00* (2006.01)

(52) U.S. Cl. ..... 27/1; 27/35; 52/133; 52/134

(58) Field of Classification Search ..... 27/35, 1; 52/128, 133, 134, 136; 211/85.27; 232/44, 232/43.3
See application file for complete search history.

(56) References Cited

U.S. PATENT DOCUMENTS

| | | | | |
|---|---|---|---|---|
| 1,585,411 | A | 5/1926 | Patterson | |
| 3,529,730 | A | 9/1970 | Thompson | |
| 3,726,052 | A | 4/1973 | Thompson | |
| 3,754,805 | A | 8/1973 | Pangburn et al. | |
| 4,521,999 | A | 6/1985 | Flanagan | |
| 5,080,251 | A | 1/1992 | Noack | |
| 5,765,269 | A * | 6/1998 | Zarth | 27/26 |
| D433,209 | S | 10/2000 | Baldwin et al. | |
| 6,421,890 | B1 * | 7/2002 | Biggar | 27/1 |
| 6,681,534 | B2 * | 1/2004 | David et al. | 52/134 |
| 6,944,921 | B1 | 9/2005 | Gersten | |
| 7,036,195 | B2 * | 5/2006 | Glass | 27/1 |
| D541,002 | S | 4/2007 | Biggar | |
| 7,287,306 | B1 | 10/2007 | Green | |
| 7,478,461 | B2 * | 1/2009 | Glass | 27/1 |
| 7,739,776 | B2 * | 6/2010 | Hume | 27/35 |
| 2006/0179624 | A1 | 8/2006 | Glass | |

* cited by examiner

*Primary Examiner* — William L. Miller
(74) *Attorney, Agent, or Firm* — John K. McCormick

(57) ABSTRACT

Provided herewith is an apparatus and means for interning a plurality of cremated remains and their accompanying urns in a single columbarium such that the ashes and urns are inaccessible once they are interned. The apparatus comprises a plurality of vertically stacked slanted trays for retaining the urns and a telescoping cylinder with built in ramps. The telescoping cylinder is raised in the columbarium, the urn placed in a ramp in the cylinder and the cylinder lowered back into the columbarium. The cylinder is then rotated and the urn rolls by gravitational force onto the tray for permanent storage. A storage container is available to store DNA or other memorabilia of the deceased that is accessible at a future date. There is a ring binder type structure on the top of the columbarium to inscribe or attached the deceased individual's particulars.

36 Claims, 10 Drawing Sheets

APPARATUS AND MEANS FOR THE INTERNMENT OF THE DECEASED

FIELD OF THE INVENTION

The field of this invention relates generally to the storing of cremated remains, and more specifically to storing multiple cremated remains underground in a non-accessible multi-unit columbarium pod.

BACKGROUND OF THE INVENTION

Throughout recorded history, cultures and civilizations have utilized rituals and ceremonies to commemorate the loss of a loved one or a member of the community. These ceremonies can be extremely large and ornate, such as for individuals with a high public profile or high political office, or they can be simple and reserved ceremonies. The rituals and ceremonies serve a variety of needs. One of those needs is to provide a means of closure for the surviving members of the community and to aid the living in coping with the loss of someone dear to them.

In many instances, a family will choose to be interned in a common plot or location for eternity. For example, a family plot may contain burial spaces for a husband and wife, their parents or grandparents, their brothers and/or sisters, their children and their spouses and so forth depending upon the circumstances and desires of the deceased. Familial plots are common and serve both to remember the deceased as well and recognizing those that have gone before them. It also provides a sense that the deceased in still with family.

In many instances, the deceased has chosen to be embalmed and interned in a coffin in the ground. In other instances, the deceased has chosen to be cremated. Cremation has gained in popularity mainly because it is less costly and consumes less land space. For those electing cremation, there are many options as to what can be done with their cremated remains. Some elect to have their remains scattered over some specified location, either on earth or in space. Others elect to have their remains placed in a suitable urn, which can either be kept by the deceased's family or placed in an above ground communal columbarium or in a familial columbarium, either above or below ground. Many prefer a familial columbarium over a communal one for the sense of history and family is represents.

Interning cremated remains in a communal columbarium over conventional whole-body casket burials is attractive to cemetery owners, mostly due to the reduced space requirements which frees up available space for future burials. A familial columbarium, while requiring less space than a casket burial can still consume more space than a communal columbarium as the urns are typically placed side by side in a horizontal position. In addition, when a newly deceased individual's remains are added to the familial plot, it may necessary to open the familial columbarium to place the new urn in the columbarium thereby providing access to the prior interned urns.

It is desirable therefore to have a columbarium that can store a plurality of cremated remains in a more space efficient manner to better utilize the limited supply of cemetery land while assuring that there is no access to prior interned cremated remains.

SUMMARY OF THE INVENTION

The apparatus and method of the present invention is directed towards using a buried columbarium pod. In one embodiment, a hole is dug into the ground and the columbarium pod is secured into the hole by the use of base level flanges attached to the columbarium pod and over which concrete or other securing material is poured. The hole is then filled in around the columbarium pod. On one part of the columbarium pod there is a circular opening with a cylindrical tube attached thereto extending from slightly above an inner horizontal surface inside the columbarium pod to a position near the bottom of the pod. Placed inside of the cylindrical tube is a telescoping cylinder with slanted ramps within the telescoping cylinder that has open spaces at the end of the ramps in the telescoping cylinder. The top of the telescoping cylinder has a handle and means for securing the telescoping cylinder near the top of the columbarium pod. Adjacent to the telescoping cylinder there are a plurality of trays, stacked vertically along the length of the telescoping cylinder with one end of the tray open to the cylindrical tube and the ramp in the telescoping cylinder. Each tray slanting slightly downward from the telescoping cylinder ramps with partitions internal to each tray that form an "S" shaped path. The trays being separated from each other by the underside of the preceding tray. Above the top tray opening and separate from the top tray there is a separate storage container opening with a storage container lid that can be securely sealed to the storage container opening.

In use, a user would un-secure the telescoping cylinder and rotate the cylinder roughly 90 degrees. The user would then raise the telescoping cylinder and place a spherical urn, with the cremated remains in the urn, onto one of the ramps in the telescoping cylinder. The user then slides the telescoping cylinder back down the cylindrical tube to its full depth. The telescoping cylinder is then rotated such that the opening in the telescoping cylinder and its ramps are in line with the opening in the cylindrical tube and aligned with the trays. Because of the downward angle of the ramp and the trays, the spherical urn rolls by gravitational force onto the specified tray to its final resting position inside the columbarium pod at the end of the "S" shaped path on the tray. The telescoping cylinder is then turned to its home position in the cylindrical tube and secured to the inner horizontal surface. The telescoping cylinder is designed with tabs at the bottom of the cylinder such that the cylinder can be rotated and raised or lowered, but it can not be removed from the cylindrical tube. Thus, once a spherical urn is placed into the columbarium, the urns are secured from any further access. Other mementos, pictures, treasures or other items significant to the deceased or family members can then be placed into a spherical container and similarly deposited next to the previously interned urn. In addition, deoxyribonucleic acid, or DNA, samples or other items can be identified and placed into the storage container opening and secured with a locking storage container lid if desired.

Once interned, a commemorative plaque can be engraved with the name and particulars of the deceased and their location in the columbarium and placed inside the columbarium lid on a ring binder like holder.

Other features and advantages of this disclosure will become apparent to one skilled in the art upon examination of the following drawings and detailed description. It is intended that all such additional features and advantages be included within the scope of the present invention.

BRIEF DESCRIPTION OF THE DRAWINGS

A system and a method according to the invention will be described in more detail by means of a preferred embodiment with reference to the appended drawings in which.

DETAILED DESCRIPTION OF THE INVENTION

Figure 1:
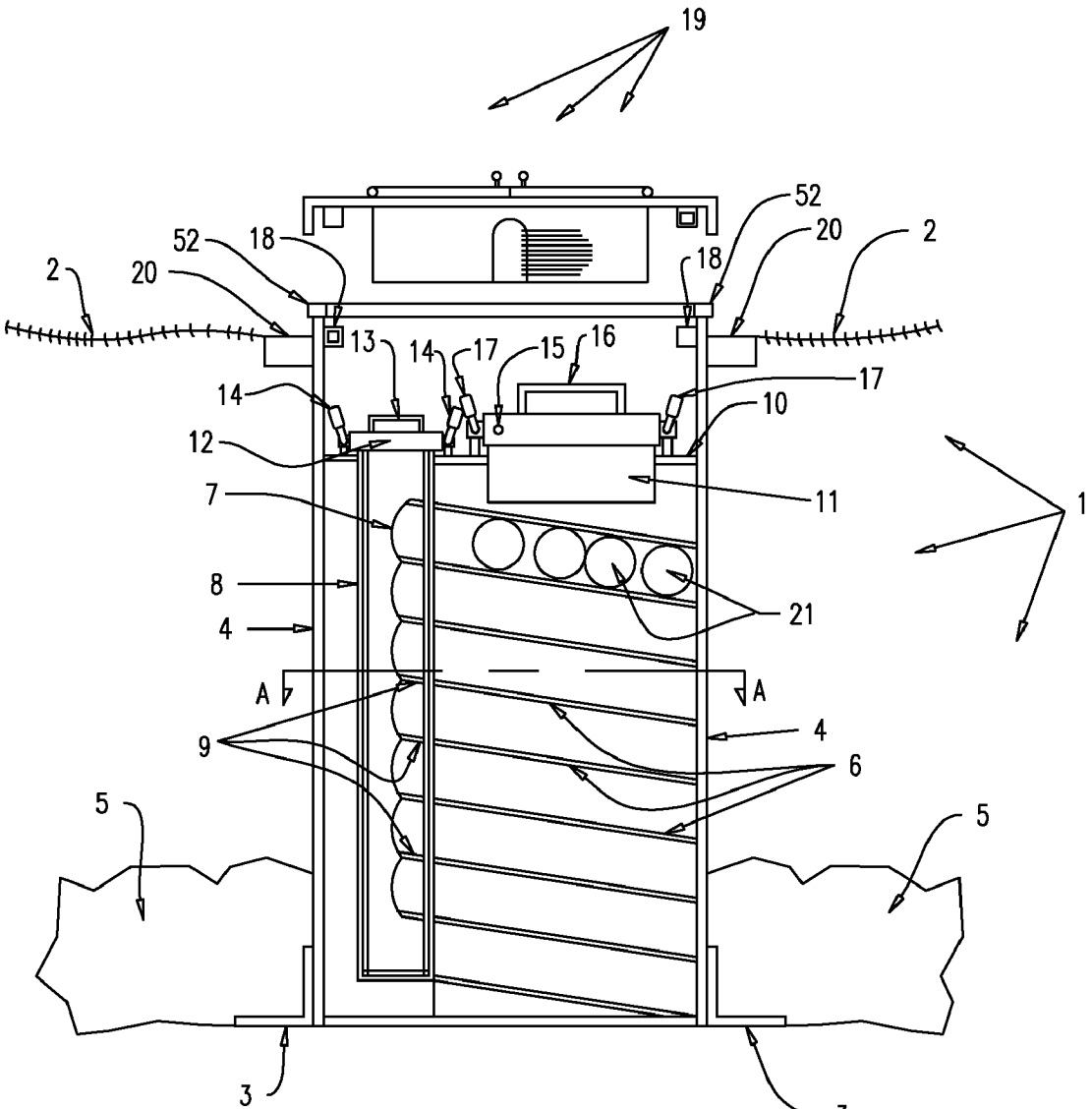
FIG. 1 is a cut-a-way planar view of the present invention as installed in the ground.

Reference will now be made in detail to the description of the invention as illustrated in the drawings. Although the invention is described in connection with the drawings, there is no intent to limit the invention to the embodiment or embodiments disclosed therein. On the contrary, the intent is to include all alternatives, modifications, and equivalents included within the scope and spirit of the invention as defined by the appended claims.

Referring to FIG. 1, the cremation storage apparatus (also commonly known as a columbarium) 1 is depicted in a first preferred embodiment installed in the ground 2 with a portion of the columbarium side walls 4 projecting above the ground 2. There are a plurality of base flanges 3 attached near the base 42 of the columbarium to the side walls 4 (only two shown) with concrete 5 poured over the base flanges 3 to secure the columbarium into the ground. Dirt and back fill are then filled in on top of the poured concrete. There are a plurality of slanted trays 6 stacked vertically inside of the columbarium 1. A telescoping cylinder 7 is depicted in its normally lowered position in a cylindrical tube 8 that is fixed to an inner horizontal surface 10. The telescoping cylinder 7 has a plurality of ramps 9 that align with the slanted trays 6 when the telescoping cylinder is rotated to the "Intern" position. Some urns 21 are depicted as being stored on one of the slanted trays 6. The urns 21 are shaped such that they will roll, such as, but not limited to, cylindrical urns and spherical urns.

A circular top 12 with a handle 13 is fixedly attached to the top of the telescoping cylinder 7. The circular telescoping top 12 and handle 13 allow the telescoping cylinder 7 to be raised and lowered in the cylindrical tube 8. There is at least one locking means 14 for securing the telescoping cylinder 7, circular top 12 and handle 13 to the inner horizontal surface 10. A weatherproof seal (not shown) is between the top 12 and the top of the cylindrical tube 8. When unsecured, the telescoping cylinder 7 is rotatable within the cylindrical tube 8.

There is a storage container 11 in the inner horizontal surface 10 for use in storing various artifacts such as DNA samples or the like. There is a storage container lid 15 and handle 16 for the storage container 11 and at least one locking means 17 for securing the storage container lid 15 and handle 16 to the inner horizontal surface 10. A weatherproof seal (not shown) is between the storage container lid 15 and the storage container 11 to prevent water and debris from entering the storage container 11. Near the top of the inside of the columbarium 1 are a plurality of columbarium lid rests 18 for securing the columbarium lid 19 with a resilient seal 52 between the lid 19 and the columbarium side walls 4. There is also an outer ledge 20 near the top of the columbarium 1.

Figure 2:
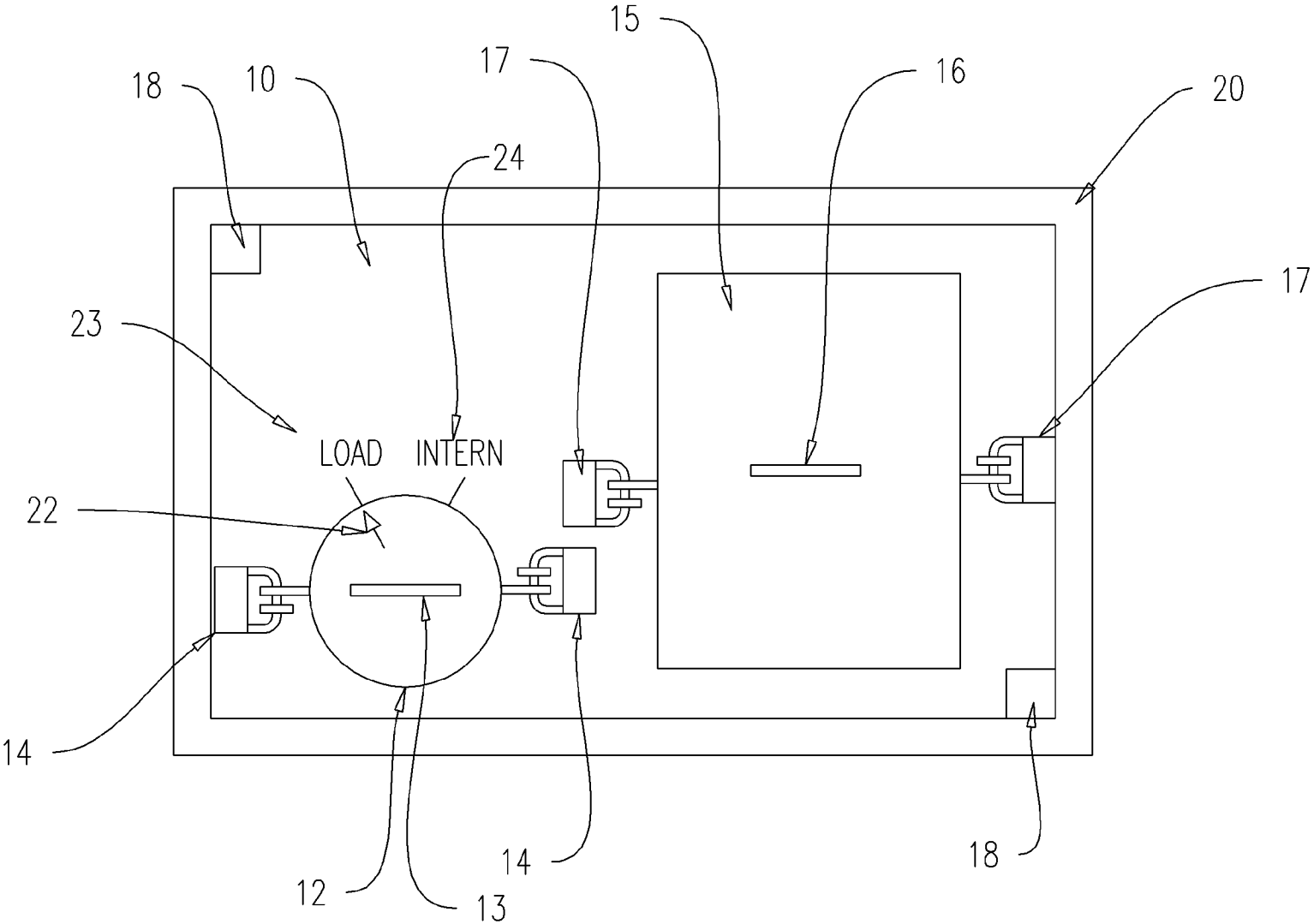
FIG. 2 is a planar top down view of the inside of the present invention.

FIG. 2 depicts the top inside horizontal surface 10 with the outer ledge 20 and the inner rests 18. The telescoping cylinder top 12 is depicted with an indicator arrow 22 on top of the circular top 12. The inner horizontal surface 10 is shown with indicators for "Load" 23 and "Intern" 24 although other appropriate symbols or language could be used as indicators of the position of the telescoping cylinder 7. The use of these indicators will be discussed in greater depth further in the description.

Figure 3:
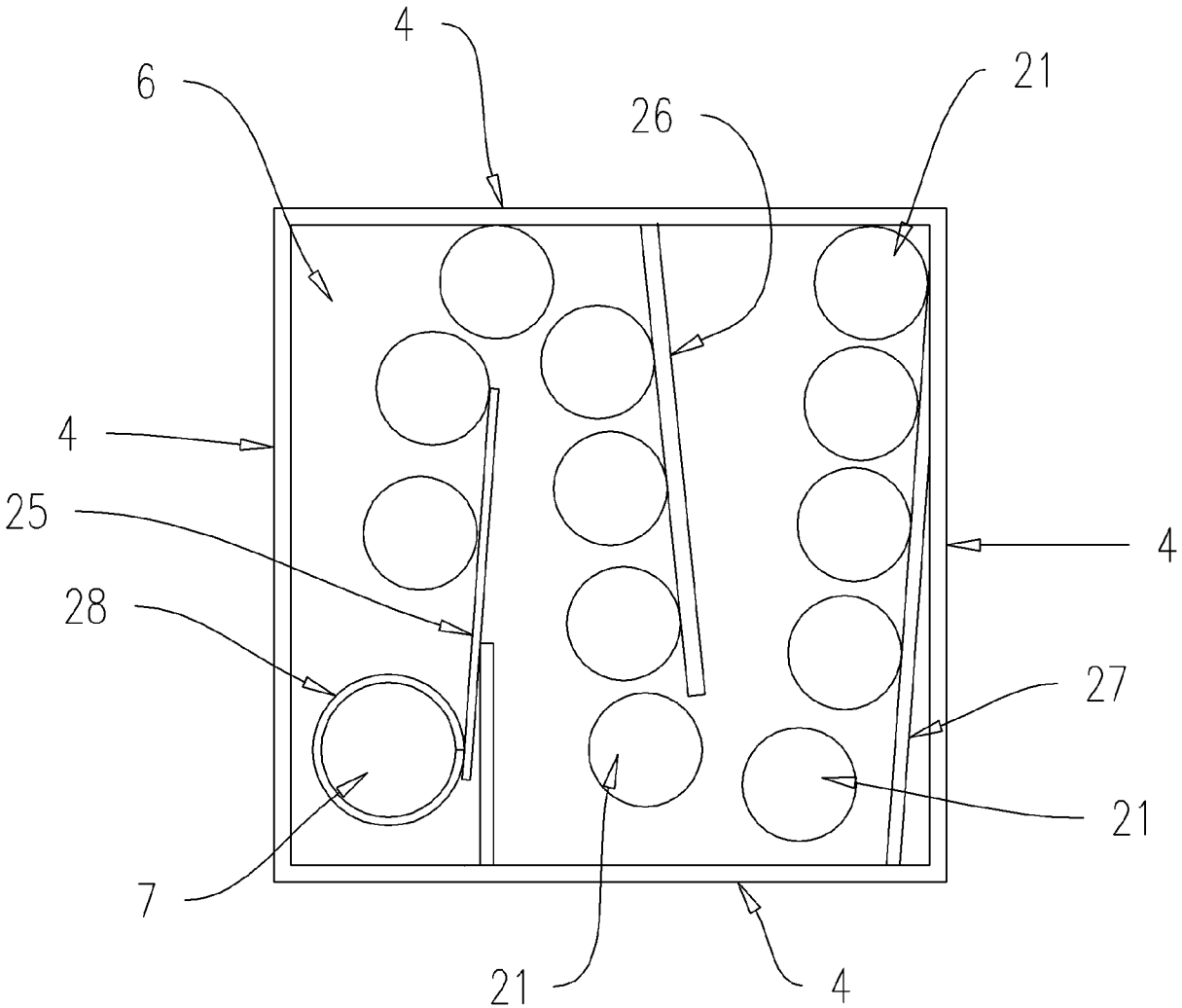
FIG. 3 is a planar top down cut-away view of the present invention taken at Section A-A of FIG. 1.

FIG. 3 depicts a top down cut away view of the columbarium taken at section A-A on FIG. 1. Each slanted tray 6 has a series of guide plates 25, 26 and 27 and a circular cutout 28 for the telescoping cylinder 7. As a spherical urn 21 is deposited on the slanted tray 6, the urn 21 rolls down the slated tray 6 guided by the guide plates 25, 26 and 27 until the urn 21 reaches the bottom of the tray 6 or until it bumps into a prior deposited urn 21. Although FIG. 3 depicts the single tray 6 being able to hold twelve (12) urns 21, it would be obvious to those skilled in the art that the tray could be designed to hold many more urns 21 by enlarging the tray 6 or as few as only one urn 21 by reducing the size of the tray 6.

Figure 4:
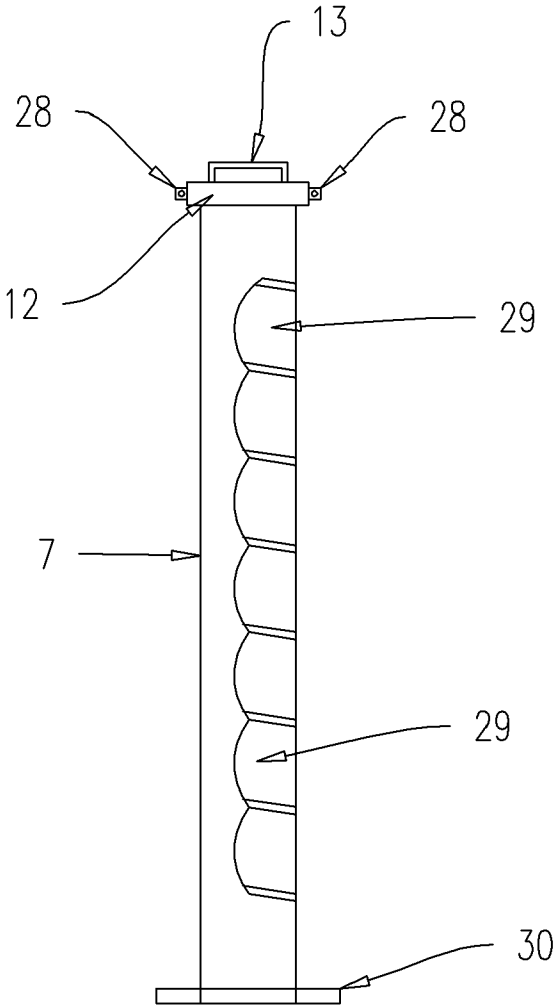
FIG. 4 is a planar side view of the telescoping cylinder of the present invention.
Figure 5:
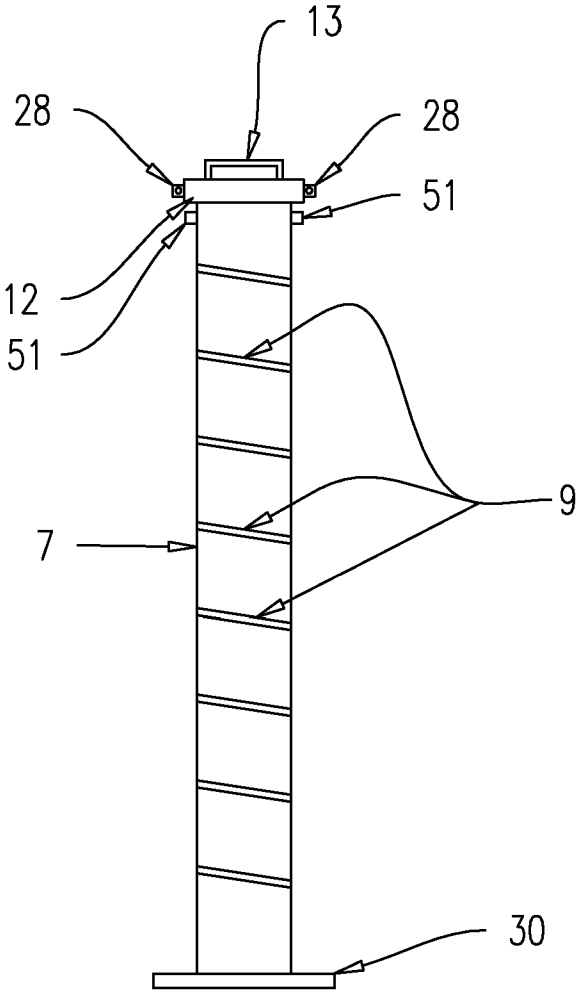
FIG. 5 is a planar cut-a-way side view of the telescoping cylinder of the present invention.

FIG. 4 depicts a side view of the telescoping cylinder 7 with the circular top 12 and handle 13. Attached to the circular top 12 in at least one location is a tab 28 for securing the telescoping cylinder 7 to the inner horizontal surface 10. The sides of the telescoping cylinder 7 have openings 29 that correspond to each of the ramps 9 that allow the spherical urns 21 to exit the telescoping cylinder 7. The bottom tabs 30 allows the telescoping cylinder 7 to be raised, lowered and rotated but prevents the telescoping cylinder 7 from being removed from the cylindrical tube 8 thereby preventing access to prior deposited urns 21. FIG. 5 is a cut-away side view of the telescoping cylinder 7 depicting the ramps 9 in the telescoping cylinder 7 and the resilient seal 51.

Figure 6:
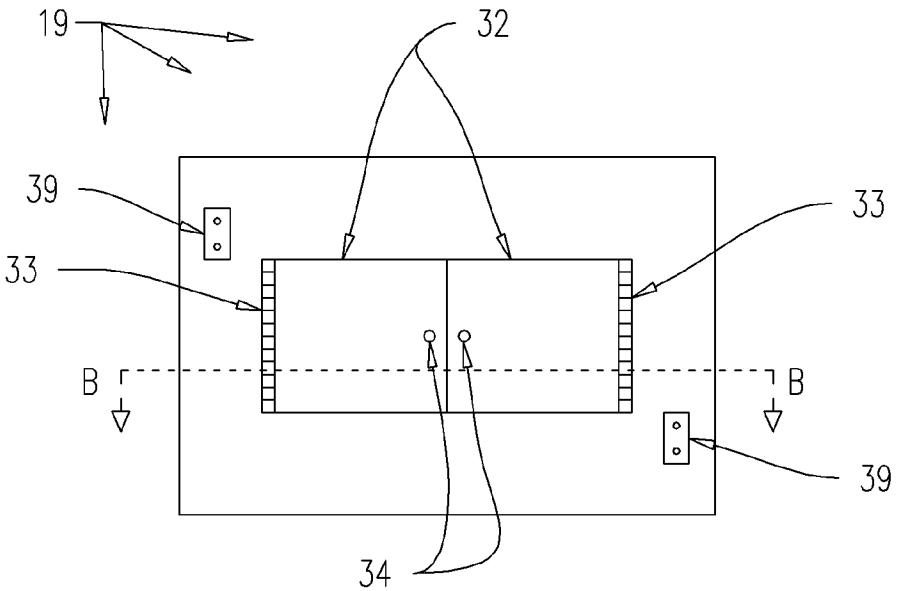
FIG. 6 is a planar top view of the lid of the present invention.
Figure 7:
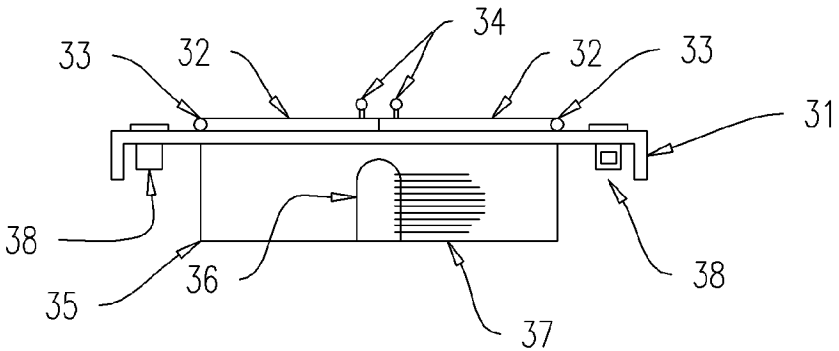
FIG. 7 is a planar side cut-a-way view of the lid of the present invention taken at Section B-B of FIG. 6.

FIG. 6 is a top view of the columbarium lid 19 and FIG. 7 is a cut away front end view of the columbarium lid 19. The lid 19 has down turned edges 31 on all four sides to aid in preventing moisture and/or debris from entering the columbarium 1. There is also a weatherproof seal (not shown) between the underside of the columbarium lid 19 and the top of the columbarium side walls 4 to prevent moisture and debris from entering the columbarium 1. The doors 32 are hinged 33 at the outer edges of the doors 32. There are door handles 34 to assist in opening the doors 32. Underneath the doors 32 there is a holding box 35. Fixed to the inside of the box 35 is a ring binder 36 like apparatus. Rotatably attached to the ring binder 36 are a series of plaques 37 to which the particulars of a deceased person (not shown) are inscribed or attached thereto. There is also a weatherproof seal (not shown) between the doors 32 and the holding box 35 to prevent moisture and/or debris from entering the box 35. There are two keyed locking mechanisms 38 on the underside of the columbarium lid 19, one facing forward and the other backward. The key holes (not shown) are protected from the weather and debris by covers 39 on the top side of the columbarium lid 19.

Figure 8:
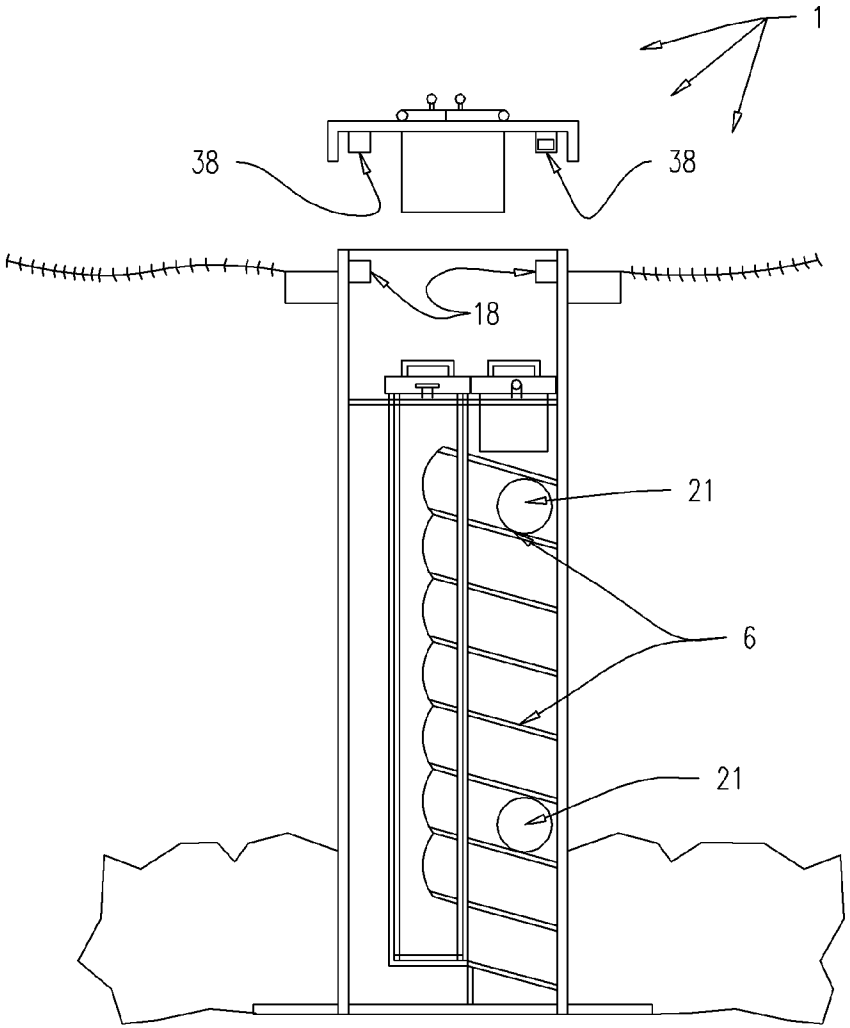
FIG. 8 is a cut-a-way planar view of a second embodiment of the present invention as installed in the ground.
Figure 9:
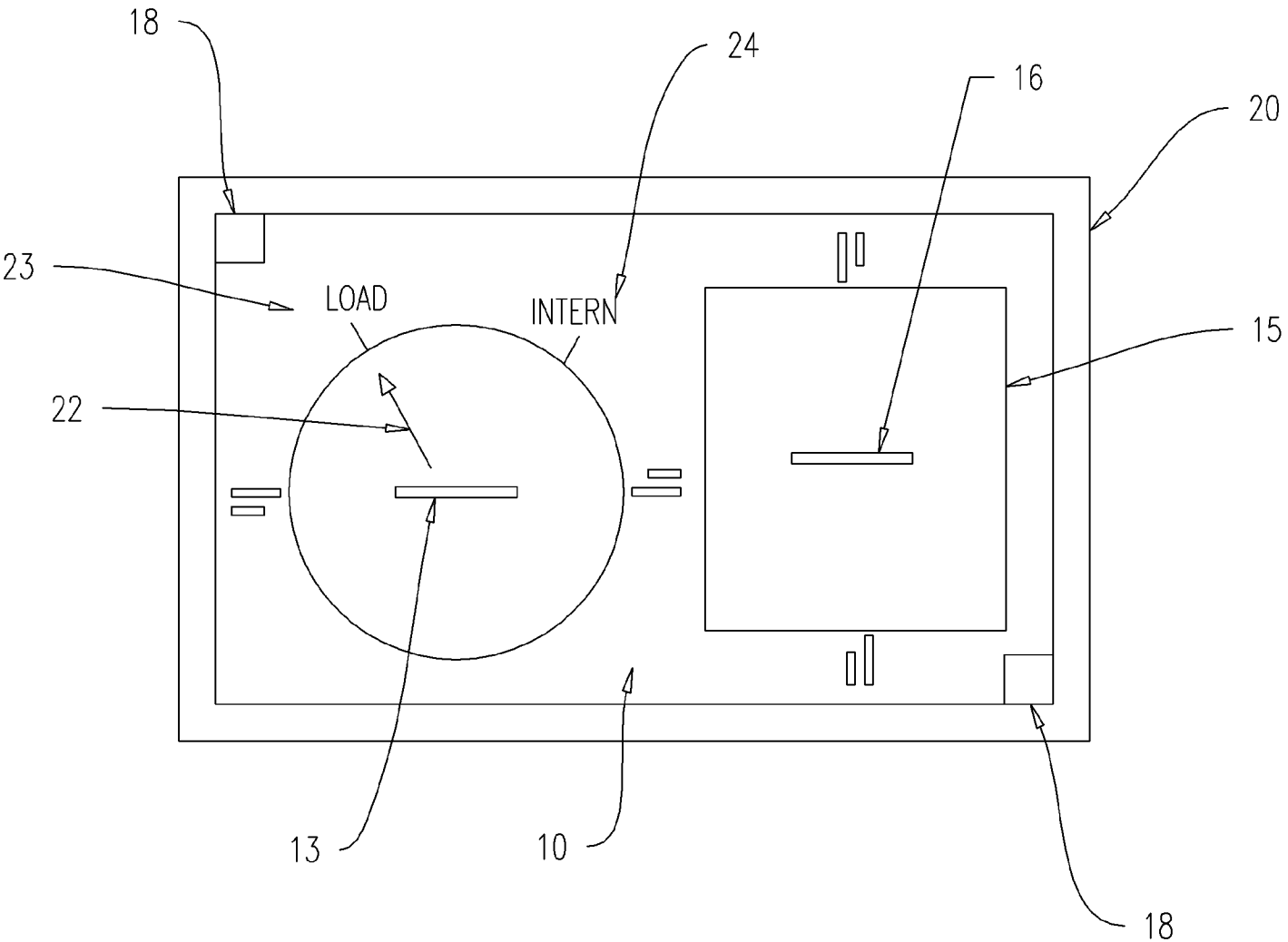
FIG. 9 is a planar top down view of the inside of the second embodiment of the present invention.

In an alternative embodiment of the invention depicted in FIG. 8 as a side view of the columbarium 1, each of the urns 21 are loaded onto a tray 6 that only has space for a single urn. Thus, the urns 21 and remains of the members of a given family or group can be placed vertically in designated spots created by the trays 6 thereby allowing members to choose whom they would like to be interned next to for all eternity. As depicted in FIG. 9, the top of the horizontal surface 10 has a substantially reduced foot print as compared to the columbarium 1 of FIG. 2 thereby reducing the cemetery space required for the columbarium 1 for a given family or group.

Figure 10:
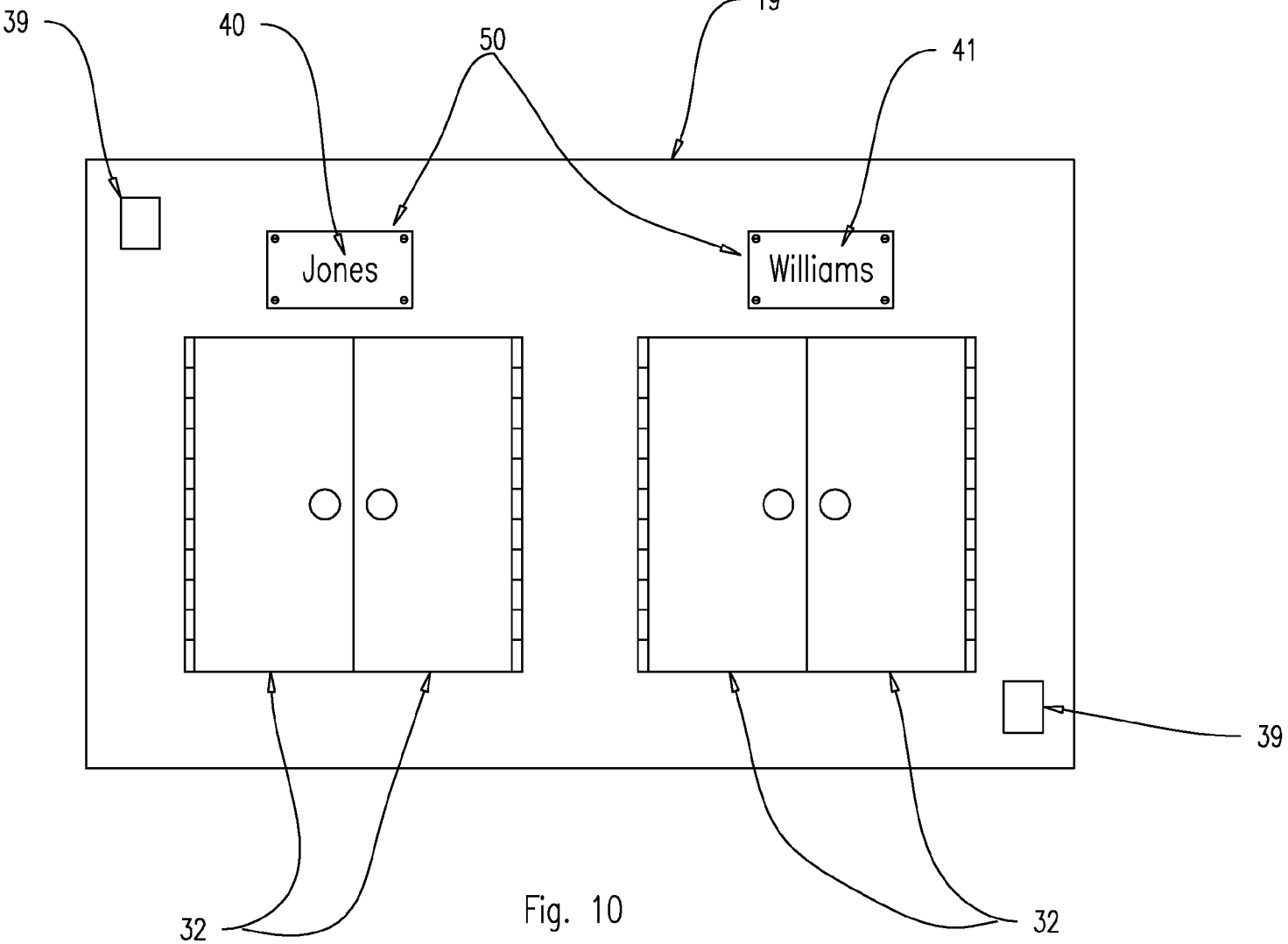
FIG. 10 is a planar top down view of a third embodiment of the lid of the present invention.
Figure 11:
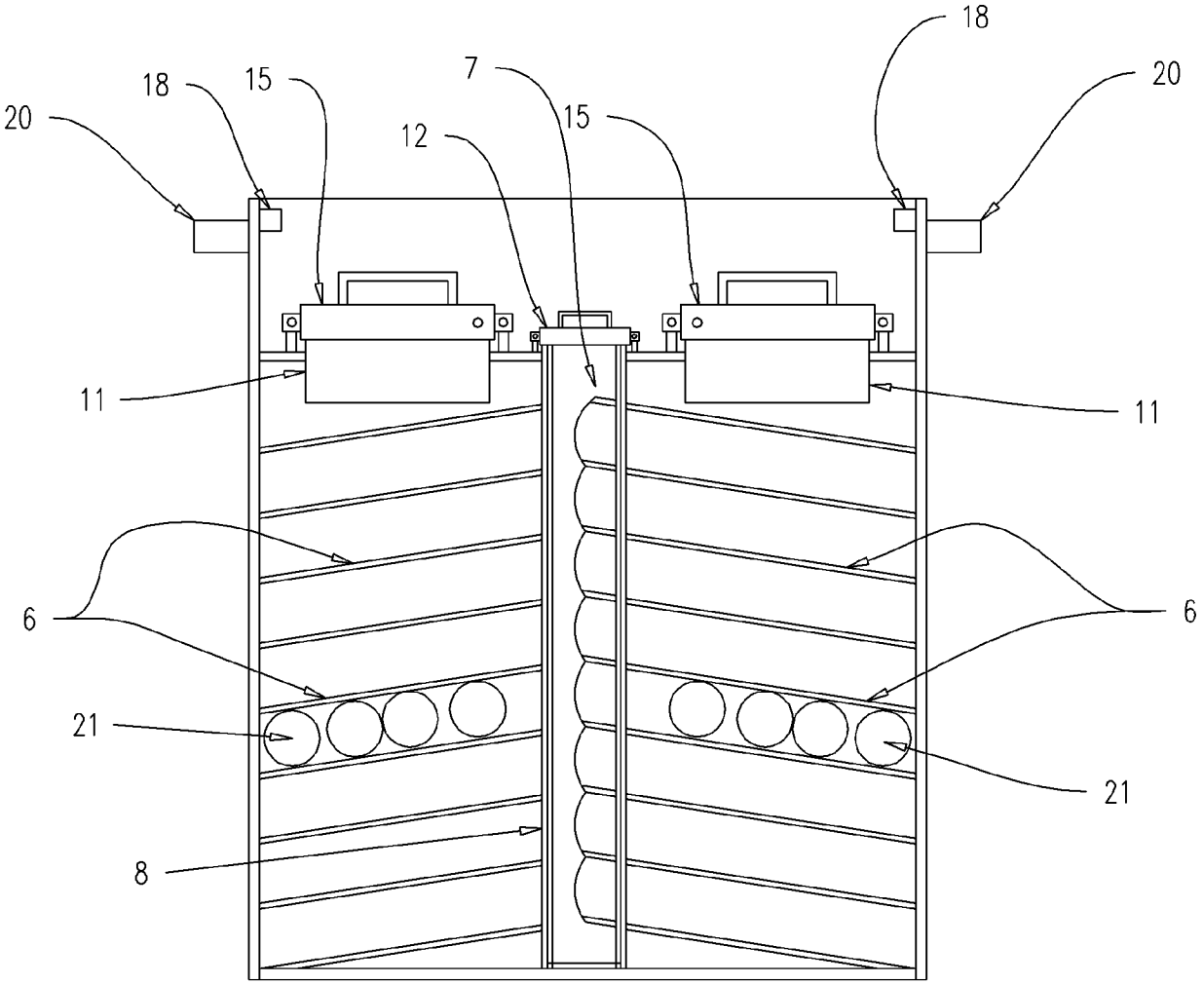
FIG. 11 is a cut-a-way planar view of a third embodiment of the present invention as installed in the ground.

In another embodiment of the present invention as depicted in FIGS. 10 and 11, a side by side multi-familial columbarium 1 is depicted. FIG. 10 depicts a top down view of the columbarium lid 19 containing two sets of doors 32, one for each family and two familial names 40 and 41 inscribed or attached to the columbarium lid 19 by a plaque 50. There are two (2) storage containers 11 and two (2) storage container lids 15, one for each family. There is a single telescoping cylinder 7.

FIG. 11 depicts the cross sectional view of a multi-family columbarium wherein there are trays 6 on either side of the telescoping cylinder 7, one set of trays 6 for each family. The telescoping cylinder 7 would be turned either clock-wise or counter clock-wise, depending upon the family, in order to position an urn 21 into a specific family's location in the columbarium.

In other alternative embodiments, the columbarium lid 19 and/or the storage container lid 15 could be hinged on one side such that the lids 19 and 15 pivots open rather than being lifted off. In other embodiments, there are no doors 32, handles 34, hinges 33 or holding box 35 on the columbarium lid 19, but rather a single plaque (not shown) mounted to the outer surface of the columbarium lid 19 to record the individuals' particulars. It should be noted that the actual overall shape of the columbarium could take on numerous versions, such as cylindrical, rectangular, square, etc., while still embodying the scope and intent of the invention. In another embodiment, the telescoping cylinder top 12 is threaded into place on the cylindrical tube 8. In another embodiment there is a removable table that is placed on top of the inner horizontal surface with sufficient space between the table and the lid to allow for non-rolling urns to be placed on the table for storage.

For all of the embodiments of the aforementioned invention, at the time of internment for a deceased's ashes and urn 21, the columbarium lid 19 has the lock covers 39 removed and the lid unlocked 38. The columbarium lid 19 is then removed or lifted back. The telescoping cylinder 7 is then unsecured 14 from the inner horizontal surface 10 and lifted up to the desired position corresponding to one of the ramps 9 in the telescoping cylinder 7. The ashes and urn 21 are then placed on the designated ramp 9 in the telescoping cylinder 7 and the telescoping cylinder 7 with ashes and urn 21 are lowered back to its bottom position. The telescoping cylinder 7 is then rotated to the "Intern" position so as to align the openings 29 in the telescoping cylinder 7 with the trays 6 in the columbarium 1. By gravitation force, the spherical urn 21 then rolls onto the designated tray 6. Any other mementoes can be similarly interned next to the deceased if desired. The telescoping cylinder 7 is then rotated back to its original position and secured to the inner horizontal surface 10. The storage container 11 can then be unsecured 17 and opened for the placement of any DNA samples or other items. The storage container 11 can then be secured 17 to the inner horizontal surface 10. The columbarium lid 19 is then placed back on top of the columbarium side walls 4 and the columbarium 1 secured. The lock covers 39 are then replaced. The doors 32 on the columbarium lid 19 can then be opened and the deceased's particulars engraved or secured to a plaque 37 attached to the ring binder 36 positioned underneath the doors 32. The doors 32 are then closed and the internment ceremony completed.

I claim:

1. A cremation storage apparatus for storing at least one cremated remains in an urn such that said remains and urn are inaccessible once stored, said cremation storage apparatus comprising:

a base, sides, a lid and an inner horizontal surface;

said horizontal surface having an opening for a rotatable and slideable telescoping cylinder, said telescoping cylinder residing in a cylindrical tube fixed to said inner horizontal surface; said telescoping cylinder having a top and a handle on the top of said telescoping cylinder for rotating said telescoping cylinder to either a load or intern position and for raising and lowering said telescoping cylinder in said cylindrical tube;

said telescoping cylinder having a releasable securing mechanism for securing said telescoping cylinder to said inner horizontal surface;

at least one slanted shelf located beneath said horizontal surface that holds in storage at least one said urn;

at least one slanted ramp in said telescoping cylinder, said ramp being aligned with said shelf when said telescoping cylinder is at its bottom most position and when said telescoping cylinder is rotated to said intern position and said cylindrical tube having at least one opening that allows passage of said urn from said telescoping cylinder ramp to said shelf; and said lid having a releasable securing mechanism for securing said lid to said side walls and a plaque on a top side of said lid for recording personal information of said at least one cremated remains.

2. The cremation storage apparatus according to claim 1 wherein there is a resilient seal between said cylindrical tube and said top of said telescoping cylinder to prevent water and debris from entering said apparatus.

3. The cremation storage apparatus according to claim 1 wherein there is a resilient seal between a top of said sides and said lid to prevent water and debris from entering said apparatus.

4. The cremation storage apparatus according to claim 1 wherein:

said inner horizontal surface has a second opening to which a storage container is fixedly attached, said storage container have a storage container lid with a handle, said storage container lid being releasably secured to said inner horizontal surface with a securing mechanism.

5. The cremation storage apparatus according to claim 1 wherein:

said inner horizontal surface has a second opening to which a storage container is fixedly attached, said storage container have a storage container lid with a handle, said storage container lid being releasably secured to said inner horizontal surface with a securing mechanism and a resilient seal between said storage container and said storage container lid to prevent water and debris from entering said storage container.

6. The cremation storage apparatus according to claim 1 wherein said plaque on said lid is covered by at least one hinged door.

7. The cremation storage apparatus according to claim 1 wherein said urn is cylindrical in shape.

8. The cremation storage apparatus according to claim 1 wherein said urn is spherical in shape.

9. The cremation storage apparatus according to claim 1 wherein there are indicators on said inner horizontal surface and said telescoping cylinder indicating when said telescoping cylinder is rotated to either said load or said intern position.

10. The cremation storage apparatus according to claim 1 wherein there are at least one flange attached to said base for securing said storage apparatus into the ground.

11. A cremation storage apparatus for storing at least one cremated remains in an urn such that said remains and urn are inaccessible once stored, said cremation storage apparatus comprising:

a base, sides, a lid and an inner horizontal surface;

said horizontal surface having an opening for a rotatable and slideable telescoping cylinder, said telescoping cylinder residing in a cylindrical tube fixed to said inner horizontal surface, said telescoping cylinder having a top and a handle on the top of said telescoping cylinder for rotating said telescoping cylinder to either a load or intern position and for raising and lowering said telescoping cylinder in said cylindrical tube;

said telescoping cylinder having a releasable securing mechanism for securing said telescoping cylinder to said inner horizontal surface;

at least one slanted shelf located beneath said horizontal surface that holds in storage at least one said urn;

at least one slanted ramp in said telescoping cylinder, said ramp being aligned with said shelf when said telescoping cylinder is at its bottom most position and when said telescoping cylinder is rotated to said intern position and said cylindrical tube having at least one opening that allows passage of said urn from said telescoping cylinder ramp to said shelf;

said base having at least one base flange; and said lid having a releasable securing mechanism for securing said lid to said side walls and said lid having a recessed holding box with a binder for containing a plurality of commemorative plaques for recording a personal information of said at least one cremated remains per plaque, said holding box having at least one door to cover said recessed box and a resilient seal to prevent water and debris from entering said holding box.

12. The cremation storage apparatus according to claim 11 wherein there is a resilient seal between said cylindrical tube and said top of said telescoping cylinder to prevent water and debris from entering said apparatus.

13. The cremation storage apparatus according to claim 11 wherein there is a resilient seal between said side walls and said lid to prevent water and debris from entering said apparatus.

14. The cremation storage apparatus according to claim 11 wherein:

said inner horizontal has a second opening to which a storage container is fixedly attached, said storage container have a storage container lid with a handle, said storage container lid being releasably secured to said inner horizontal surface with a securing mechanism.

15. The cremation storage apparatus according to claim 11 wherein:

said inner horizontal surface has a second opening to which a storage container is fixedly attached, said storage container have a storage container lid with a handle, said storage container lid being releasably secured to said inner horizontal surface with a securing mechanism with a resilient seal between said storage container and said storage container lid to prevent water and debris from entering said storage container.

16. The cremation storage apparatus according to claim 11 wherein said urn is cylindrical in shape.

17. The cremation storage apparatus according to claim 11 wherein said urn is spherical in shape.

18. The cremation storage apparatus according to claim 11 wherein the are indicators on said inner horizontal surface and said telescoping cylinder indicating when said telescoping cylinder is rotated to either said load or said intern position.

19. The cremation storage apparatus according to claim 11 wherein there are at least one flange attached to said base for securing said storage apparatus into the ground.

20. A method of storing at least one urn in a columbarium such that said urn and cremated remains are inaccessible once stored, said method comprising the steps of:

raising a telescoping cylinder up but not out of an opening from an inner horizontal surface in said columbarium;

placing said urn onto a ramp inside of said telescoping cylinder;

lowering said telescoping cylinder with said urn into said opening;

rotating said telescoping cylinder to an intern position wherein said urn rolls off said ramp and onto a slanted shelf in said columbarium;

rotating said telescoping cylinder to a load position.

21. The method of storing at least one urn according to claim 20 wherein there is a sealing means between said opening and a top of said telescoping cylinder to prevent water and debris from entering said columbarium.

22. The method of storing at least one urn according to claim 20 wherein there is a lid for a top of the columbarium and a sealing means between said columbarium and said lid to prevent water and debris from entering said columbarium.

23. The method of storing at least one urn according to claim 20 comprising the additional steps of:

opening a storage container located in said inner horizontal surface;

placing mementoes in said storage container; and closing said storage container.

24. The method of storing at least one urn according to claim 20 wherein there is a lid for a top of the columbarium, said lid having a plaque attached to said lid for recording at least one deceased person's information and at least one door for covering said plaque.

25. The method of storing at least one urn according to claim 20 wherein said urn is cylindrical in shape.

26. The method of storing at least one urn according to claim 20 wherein said urn is spherical in shape.

27. The method of storing at least one urn according to claim 20 wherein there are means to indicate whether said telescoping cylinder is in a load or an intern position.

28. The method of storing at least one urn according to claim 20 wherein there are means for securing said columbarium into the ground.

29. A method of storing at least one urn in a columbarium such that said urn and cremated remains are inaccessible once stored, said method comprising the steps of:

opening a lid on said columbarium;

raising a telescoping cylinder up but not out of an opening in an inner horizontal surface in said columbarium;

placing said urn onto a ramp inside of said telescoping cylinder;

lowering said telescoping cylinder with said urn into said opening;

rotating said telescoping cylinder to an intern position wherein said urn rolls off said ramp and onto a slanted shelf in said columbarium;

rotating said telescoping cylinder to a load position;

placing a lid on top of said columbarium;

opening a door on a top of said lid;

recording the personal information of at least one cremated remains on a recording mechanism; and closing said door on top of said lid.

30. The method of storing at least one urn according to claim 29 wherein there is a sealing means between said opening and a top of said telescoping cylinder to prevent water and debris from entering said columbarium.

31. The method of storing at least one urn according to claim 29 wherein there is a sealing means between said columbarium and said lid to prevent water and debris from entering said columbarium.

32. The method of storing at least one urn according to claim 29 comprising the additional steps of:

opening a storage container located in said inner horizontal surface;

placing mementoes in said storage container; and closing said storage container.

33. The method of storing at least one urn according to claim 29 wherein said urn is cylindrical in shape.

34. The method of storing at least one urn according to claim 29 wherein said urn is spherical in shape.

35. The method of storing at least one urn according to claim 29 wherein there are means for indicating whether said telescoping cylinder means is in said load or said intern position.

36. The method of storing at least one urn according to claim 29 wherein there are securing means for securing said columbarium into the ground.

* * * * *